US006118423A

United States Patent [19]

Rosenquist

[11] Patent Number: 6,118,423

[45] **Date of Patent: *Sep. 12, 2000**

[54] METHOD AND CIRCUIT FOR CONTROLLING CONTRAST IN LIQUID CRYSTAL DISPLAYS USING DYNAMIC LCD BIASING

[75] Inventor: Russell M. Rosenquist, Plano, Tex.

[73] Assignee: Texas Instruments Incorporated, Dallas, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/778,707

[22] Filed: Jan. 3, 1997

Related U.S. Application Data

[60] Provisional application No. 60/009,554, Jan. 3, 1996.

[51] Int. Cl.[7] ..... G09G 3/36

[52] U.S. Cl. ..... 345/95; 345/89

[58] Field of Search ..... 345/89, 94, 95, 345/211, 212

[56] References Cited

U.S. PATENT DOCUMENTS 5,250,937 10/1993 Kikuo et al. ..... 345/89
5,404,150 4/1995 Murata ..... 345/95

*Primary Examiner*—Jeffery Brier
*Attorney, Agent, or Firm*—Charles A. Brill; Frederick J. Telecky, Jr.; Richard L. Donaldson

[57] ABSTRACT

A method of controlling contrast in LCDs using dynamic LCD biasing includes the step of identifying an expected bias function as a function of LCD material, LCD operating voltage, and LCD duty cycle. The expected bias function is then approximated to obtain a linear description of the expected bias function. A voltage is generated that follows the linear description of the expected bias function. The step of generating the voltage results in dynamic LCD biasing.

15 Claims, 2 Drawing Sheets

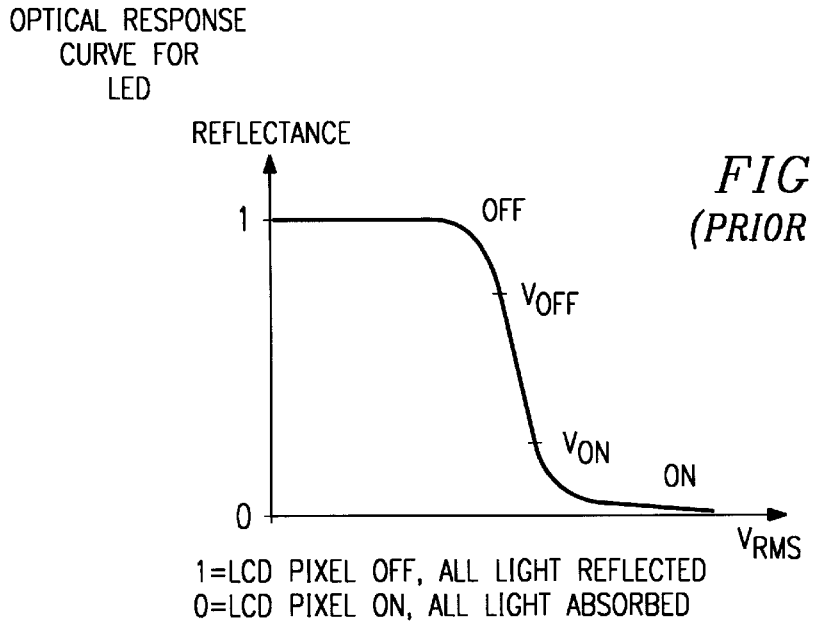
FIG. 1
(PRIOR ART)
FIG. 2
(PRIOR ART)
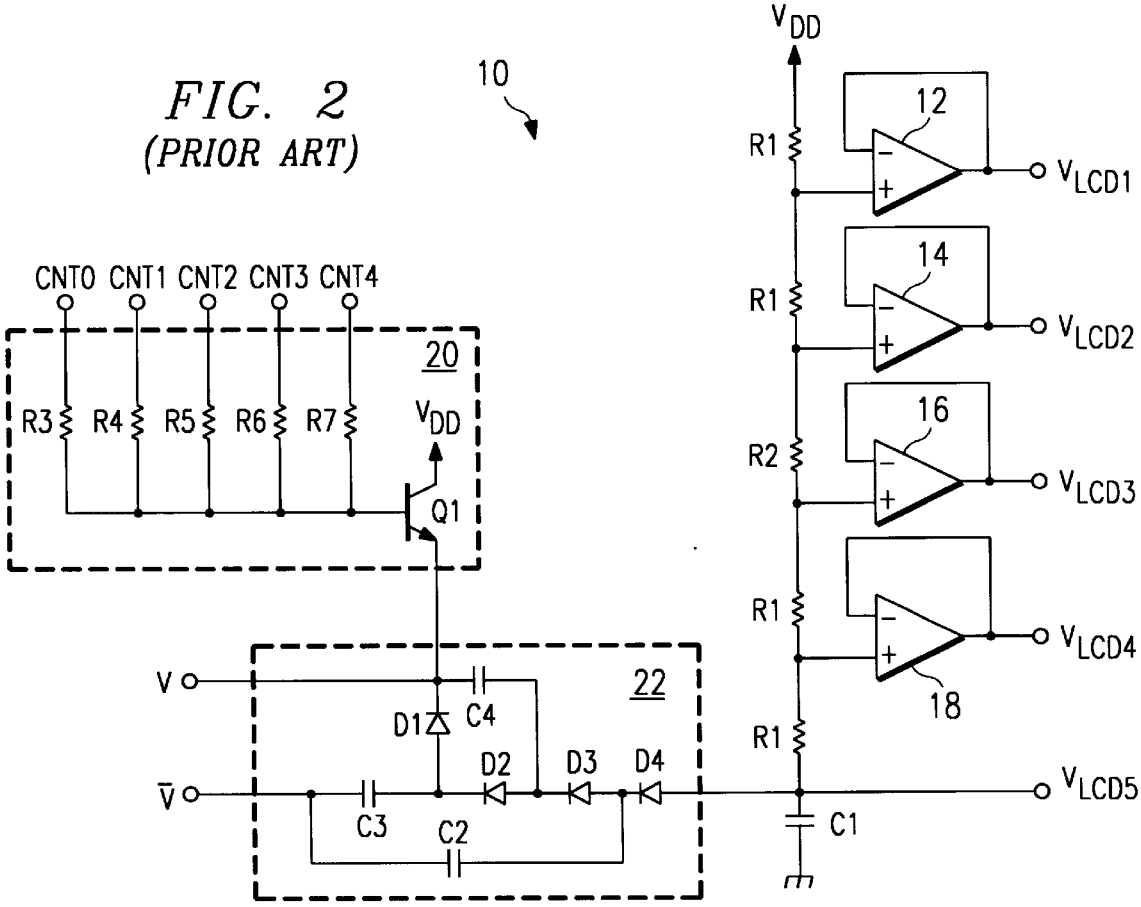

METHOD AND CIRCUIT FOR CONTROLLING CONTRAST IN LIQUID CRYSTAL DISPLAYS USING DYNAMIC LCD BIASING

This application claims priority under 35 USC § 119(e) (1) of provisional application Ser. No. 60/009,554, filed Jan. 3, 1996 pending.

FIELD OF THE INVENTION

This invention is in the field of electronic circuits and is more particularly related to biasing circuits for LCD drivers.

BACKGROUND OF THE INVENTION

Liquid crystal display (LCD) materials are well known by those skilled in the art of electronic design. LCD materials obey an optical response curve as shown in prior art FIG. 1. On the X-axis is the RMS (root mean squared) voltage across a pixel of the LCD material. On the Y-axis is the reflectance of the LCD pixel. The lower the reflectance, the darker the pixel. A "1" on the reflectance axis represents 100% light reflected (the pixel is off). A "0" on the reflectance axis represents 100% light absorbed and the pixel is on. Practically, 100% reflectance or absorption is not achieved and designers operate about the points labelled $V_{OFF}$ and $V_{ON}$. A designer must ensure that the RMS driving voltage driving each individual pixel falls within this critical transition region to achieve adequate LCD contrast. However, the location of the transition region of the optical repsonse curve is a strong function of the LCD material. Therefore as LCD materials vary, so to does the location of the curve's transition region. Bias circuits attempt to generate bias voltages that satisfy the appropriate threshold magnitudes ($V_{OFF}$ and $V_{ON}$) across all LCD operating voltages and LCD material variations.

FIG. 2 is a prior art LCD bias circuit 10 that generates a plurality of bias voltages, $V_{LCD1}$, $V_{LCD2}$, $V_{LCD3}$, $V_{LCD4}$ and $V_{LCD5}$. A resistor ladder consisting of matched resistors labelled R1 and resistor R2 establish the voltage ratios of the bias voltages. For example, if R1=100K and R2=270K the following ratios are established between the bias voltages:

$$V_{LCD1}=0.85(V_{DD}-V_{LCD5})+V_{LCD5},$$

$$V_{LCD2}=0.70(V_{DD}-V_{LCD5})+V_{LCD5},$$

$$V_{LCD3}=0.30(V_{DD}-V_{LCD5})+V_{LCD5},$$

$$V_{LCD4}=0.15(V_{DD}-V_{LCD5})+V_{LCD5}.$$

Therefore the bias voltages in prior art circuit 10 are a function of the value of $V_{LCD5}$. The bias voltages $V_{LCD1-V_{LCD4}}$ are fixed by the establishment of $V_{LCD5}$. Operational amplifiers 12, 14, 16 and 18 are unity gain buffers. LCD bias, which is defined by $[(V_{LCD3}-V_{LCD5})/2]/V_{LCD}$. Substituting $V_{LCD3}$ above into the equation for bias and simplifying, one obtains a constant (0.15). Bias is therefore fixed in the prior art solution.

The voltage value of $V_{LCD5}$ is controlled by a voltage doubler circuit 22 in conjunction with a contrast control circuit 20. Contrast control circuit 20 is a 32 bit linear control circuit that varies the voltage at node V linearly between 0V and $V_{DD}$.

This design solution is undesirable because variations in LCD voltage cause a shift in $V_{OFF}$ and therefore move the operating point outside the transition region. This design alters the contrast manually with a contrast knob or with keystrokes which effectuates the 32 bit control. Therefore contrast control must be manipulated manually. Further, the voltage output of the clock doubler circuit ($V_{LCD5}$) is unregulated, causing it to vary as batteries wear and LCD loadings change. Regulation of voltages $V_{DD}$ and $V_{LCD5}$ is expensive because it requires further voltage regulation circuitry. Further still, Q1 within contrast control circuit 20 draws substantial current resulting in inefficient power loss.

It, accordingly, is an object of this invention to provide a circuit and method of dynamically monitoring and controlling the LCD bias so that as LCD operating voltage varies, LCD bias may be dynamically adjusted to provide proper $V_{OFF}$ voltage, thereby overcoming the difficulties and limitations of the prior art. Other objects and advantages of the invention will be apparent to those of ordinary skill in the art having reference to the following specification and drawings.

SUMMARY OF THE INVENTION

A method of controlling contrast in LCDs using dynamic LCD biasing includes the step of identifying an expected bias function as a function of LCD material, LCD operating voltage, and LCD duty cycle. The expected bias function is then approximated to obtain a linear description of the expected bias function. A voltage is generated that follows the linear description of the expected bias function. The step of generating the voltage results in dynamic LCD biasing.

BRIEF DESCRIPTION OF THE DRAWINGS

FIG. 1 is a prior art diagram illustrating a reflectance curve for LCD materials.

FIG. 2 is a prior art circuit diagram illustrating a static LCD bias circuit 10.

DESCRIPTION OF THE INVENTION

Figure 3:
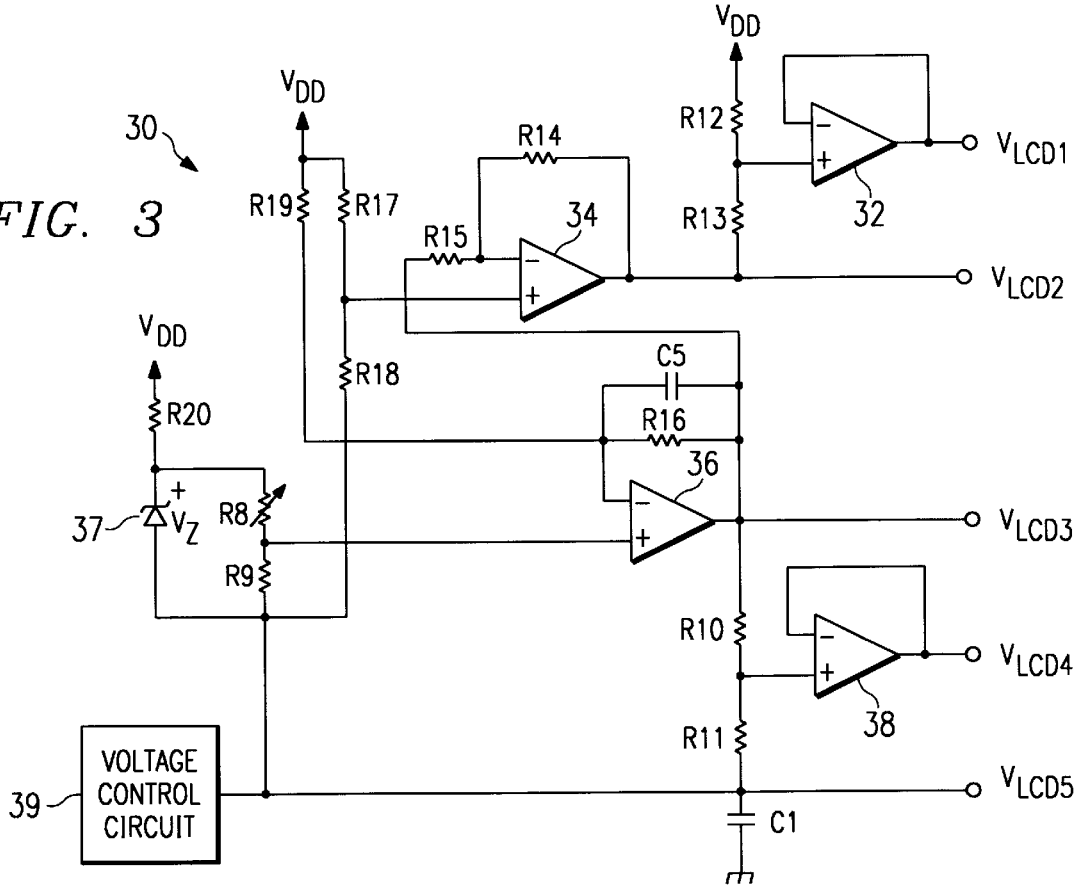
FIG. 3 is a circuit diagram illustrating an embodiment of the invention, a dynamic LCD bias circuit 30.

FIG. 3 is a circuit diagram illustrating an embodiment of the invention, an LCD bias circuit 30. Although this bias circuit is used in conjunction with an LCD circuit application, it should be understood that the invention is applicable to any type of biasing application. Circuit 30 has a voltage control circuit 39 connected to a capacitor C1 which in turn is coupled to ground potential. The node at which voltage control circuit 39 and capacitor C1 connect is labelled as $V_{LCD5}$. Two resistors, R10 and R11 are coupled in series with capacitor C1 with a positive terminal of a first operational amplifier 38 intersecting them. Op-amp 38 also has a negative input terminal coupled to its output which is labelled $V_{LCD4}$.

Resistor R10 is also connected to an output of a second operational amplifier 36 which is labelled $V_{LCD3}$. The output of op-amp 36 is coupled to its negative input terminal via a parallel resistor/capacitor network formed by resistor R16 and capacitor C5. The negative input terminal of op-amp 36 is also coupled to voltage supply $V_{DD}$ through a resistor R19. The positive input terminal of op-amp 36 intersects a series resistor network formed by potentiometer R8 (resistor) and resistor R9. Resistor R9 in turn is coupled to the node $V_{LCD5}$. A zener diode 37 having a voltage ½ thereacross is connected in parallel with resistors R8 and R9. A resistor R20 is connected between zener diode 37 and $V_{DD}$.

A third operational amplifier 34 has a positive input terminal connected to $V_{DD}$ through a resistor R17 and has a negative input terminal connected to the output of op-amp 36 through a resistor R15 and is also connected to its own output terminal via a resistor R14. The output of op-amp 34 is a node labelled $V_{LCD2}$. The output of op-amp 34 is also connected to a positive input terminal of another operational amplifier 32 via a resistor R13. Resistor R13 is also connected to $V_{DD}$ through another resistor R12. Op-amp 32 has a negative input terminal connected to its output which is a node labelled $V_{LCD1}$.

Figure 4:
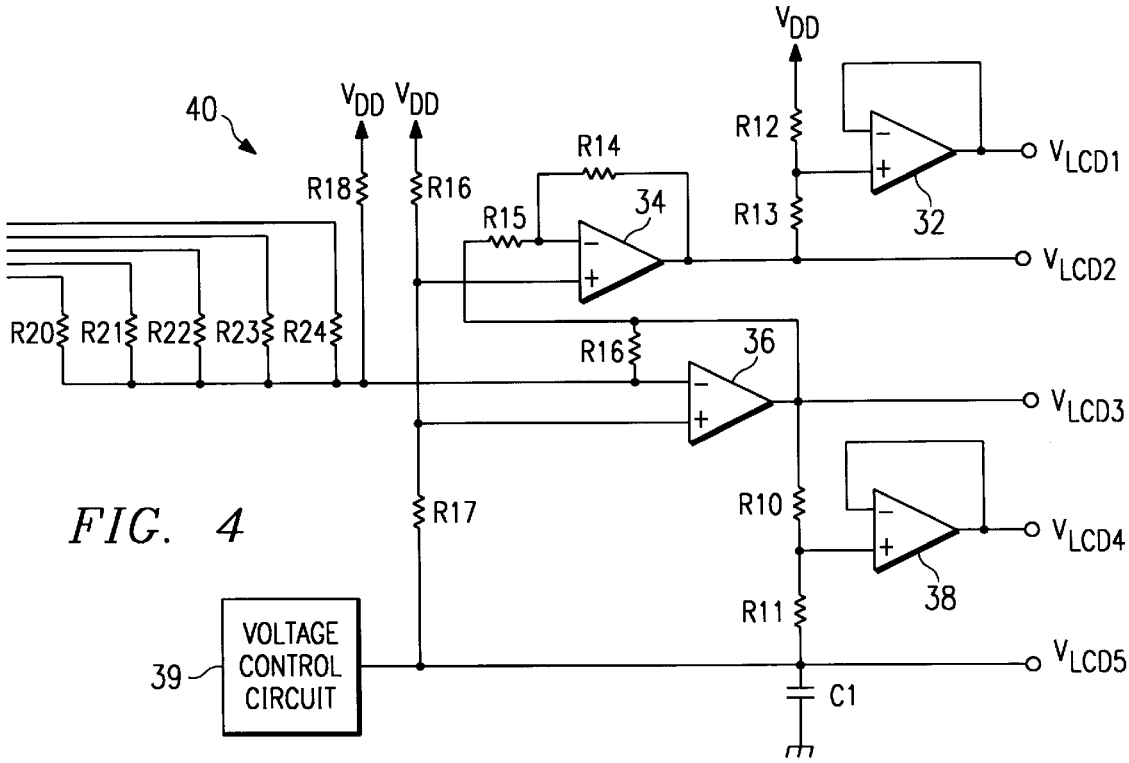
FIG. 4 is a circuit diagram illustrating an alternative embodiment of the invention, a dynamic bias circuit 40.

FIG. 4 is a circuit diagram illustrating a second alternative embodiment of the invention, LCD bias control circuit 40. Again, as in circuit 30 of FIG. 3, although this bias circuit is used in conjunction with an LCD circuit application, it should be understood that the invention is applicable to any type of biasing application. Circuit 40 has a voltage control circuit 39 connected to a capacitor C1 which in turn is coupled to circuit ground potential. The node at which voltage control circuit 39 and capacitor C1 meet is a node labelled $V_{LCD5}$.

Capacitor C1 is also coupled to a positive input terminal of op-amp 38 via resistor R11. Resistor R10 is connected between resistor R11 and the output of op-amp 36 which is a node labelled $V_{LCD3}$. Op-amp 38 has a negative input terminal connected to its output which is a node labelled $V_{LCD4}$. Op-amp 36's output is connected via resistor R16 to its negative input terminal. The negative input terminal of op-amp 36 is also coupled to a plurality of resistors R20–R24 which are connected in parallel between R16 and a digital input control circuit labelled CNT0–CNT4 as in FIG. 2. Op-amp 36 also has a positive input terminal connected to $V_{LCD5}$ via resistor R17 and to $V_{DD}$ via resistor R16. The output of op-amp 36 is also coupled to a negative input terminal of op-amp 34 through resistor R15.

Op-amp 34 has a positive input terminal connected to $V_{DD}$ through resistor R16 and has resistor R14 connected between its negative input terminal and its output which forms a node labelled $V_{LCD2}$. The output of op-amp 34 is coupled to a positive input terminal of op-amp 32 via a resistor R13. The positive input terminal of op-amp 32 is also connected to $V_{DD}$ through resistor R12. Op-amp 32 has a negative input terminal connected to its output which is a node labelled $V_{LCD1}$.

A functional description of the invention follows below. Circuit 30 of FIG. 3 novelly provides improved biasing for LCDs not by fixing bias as in prior art solutions, but rather by dynamically monitoring and adjusting LCD bias thereby providing better performance and LCD contrast stability due to variations in LCD operating voltage. As is well known in LCD device physics, setting the $V_{OFF}$ operating point for an LCD is a function of $V_{LCD}$, the duty cycle in which the LCD is driven, and the LCD bias, where $V_{LCD}=V_{DD}-V_{LCD5}$ (of FIGS. 3 and 4). Therefore:

$$V_{OFF}=f_1(V_{LCD}, \text{duty cycle, bias}).$$

It is also well known in LCD driver circuit design that bias is defined as follows:

$$\text{bias}=[(V_{LCD3}-V_{LCD5})/2]/V_{LCD}, \qquad \text{(equation 1).}$$

Using LCD physics equations, since $V_{OFF}$ is a function of $V_{LCD}$, duty cycle and bias, the equation may be rearranged and solved for bias.

$$V_{OFF}=[(DC-1)/DC(\text{bias}*V_{LCD})^2+(1/DC)(V_{LCD}-2(V_{LCD})(\text{bias}))^2]^{1/2},$$

where DC=duty cycle. In this case it can be shown that bias in turn is a function of $V_{LCD}$, duty cycle and $V_{OFF}$. Therefore:

$$\text{bias}=f_2(V_{LCD}, \text{duty cycle}, V_{OFF}), \qquad \text{(equation 2),}$$

or $$\text{bias}=[[DC^2V_{OFF}^2+DC(3*V_{OFF}^2-V_{LCD}^2)+V_{LCD}^2]^{1/2}+2V_{LCD}]/[V_{LCD}(DC+3)].$$

Equations 1 and 2 can be equated and since bias is a function of $V_{LCD3}$, the equations can be solved in terms of $V_{LCD3}$. It follows that $V_{LCD3}$ is a function of $V_{LCD}$, duty cycle and $V_{OFF}$ as follows:

$$V_{LCD3}=f_3(V_{LCD}, \text{duty cycle}, V_{OFF}).$$

Simplifying the equation using a first order Taylor's approximation around a nominal $V_{LCD}$ operating voltage (14.3V in this particular embodiment) results in the following:

$$V_{LCD3}\approx K_1V_{LCD}+V_{DD}+K_2,$$

where $K_1$ and $K_2$ are functions of the nominal $V_{OFF}$ and duty cycle, which are known, fixed quantities in any particular circuit solution. In this particular embodiment the duty cycle is 1/128 and $V_{OFF}$ is 2.1V (the nominal specced value for 90% reflectance for the particular LCD material chosen). Therefore, in this particular embodiment, $K_1\approx-1.09$ and $K_2\approx5.2$. Note that $V_{LCD3}$ is a function of $V_{LCD}$ and $V_{DD}$, where $V_{LCD}=V_{DD}-V_{LCD5}$. Both $V_{DD}$ and $V_{LCD5}$ are variables that are functions of temperature, power supply voltage and LCD capacitive loading. Therefore as $V_{DD}$ and $V_{LCD5}$ vary, so will $V_{LCD3}$ (and therefore bias).

Circuit 30 novelly creates a linear voltage relationship for $V_{LCD3}$ of $K_1V_{LCD}+V_{DD}+K_2$ that mirrors the first order approximation of $V_{LCD3}$ from the LCD device physics equations. Analyzing circuit 30 of FIG. 3, and solving the circuit equations for the variable $V_{LCD3}$ you arrive at the following:

$$V_{LCD3}=K_1V_{LCD}+V_{DD}+K_2,$$

which is identical to the above relationship for $V_{LCD3}$. In circuit 30, $$K_1=f_4(R16, R19)=-(R19+R16)/R19;$$

and, $$K_2=f_5(R8, R9, R16, R19, V_Z)=[(R16+R19)(R9*V_Z)]/R19*(R8+R9).$$

Therefore the voltage value of $V_{LCD3}$ is a linear function wherein the resistor values of R8, R9, R16, R19 and the breakdown voltage of zener diode 37 is chosen to achieve the desired $K_1$ and $K_2$ coefficients. Therefore $V_{LCD3}$ in circuit 30 will be dynamically altered via changes in $V_{DD}$ and $V_{LCD5}$ to maintain sufficient bias to provide nominal $V_{OFF}$. Circuit 30 automatically adjusts itself ($V_{LCD3}$) to modifications in $V_{DD}$ and $V_{LCD5}$ for a single LCD. Although the circuit 30 achieves the desired linear relationship for $V_{LCD3}$ it should be understood that various others circuits could be used to obtain the linear equation above. The invention contemplates other circuit solutions that achieve the novel method of dynamically monitoring and adjusting LCD bias.

The remainder of circuit 30 functions as follows. $V_{LCD4}$ is always set at a voltage value that falls halfway between the voltage values of $V_{LCD3}$ and $V_{LCD5}$ (which is required by LCD physics). This is achieved by matching resistors R10 and R11. Under voltage divider principles, the voltage value at the positive input terminal of op-amp 38 is:

$$(V_{LCD3}+V_{LCD5})[R11/(R10+R11)];$$

and, $$R10=R11.$$

Therefore one obtains, $$\tfrac{1}{2}(V_{LCD3}+V_{LCD5}).$$

Op-amp 38 is a unity gain buffer; therefore the output of op-amp 38 will be:

$$V_{LCD4}=\tfrac{1}{2}(V_{LCD3}+V_{LCD5}),$$

or (in other words) a voltage halfway between $V_{LCD3}$ and $V_{LCD5}$.

$V_{LCD2}$ is required by LCD physics to be symmetrical with $V_{LCD3}$ about the value $\tfrac{1}{2}V_{LCD}$(which is $\tfrac{1}{2}(V_{DD}+V_{LCD5})$. Expressed mathematically, $$V_{LCD2}-\tfrac{1}{2}(V_{DD}+V_{LCD5})=\tfrac{1}{2}(V_{DD}+V_{LCD5})-V_{LCD3}, \text{ or}$$

$$V_{LCD2}=V_{DD}-V_{LCD3}+V_{LCD5}.$$

This is accomplished via op-amp 34 and resistors R14, R15, R17 and R18. Using standard op-amp circuit analysis it can be shown that:

$$V_{LCD2}=[R15(R17*V_{LCD5}+R18*V_{DD})-R14(V_{LCD3}-V_{LCD5})+R18(V_{LCD3}-V_{DD})]/R15(R17+R18).$$

If R15=R14 and R17=R18, then the equation simplifies to:

$$V_{LCD2}=V_{DD}-V_{LCD3}+V_{LCD5}.$$

$V_{LCD1}$ is calculated in a manner similar to $V_{LCD4}$. Op-amp 32 operates as a unity gain buffer. Setting R12=R13 one obtains:

$$V_{LCD1}=\tfrac{1}{2}(V_{DD}+V_{LCD2}).$$

Therefore the voltage magnitude of $V_{LCD1}$ will fall halfway between $V_{DD}$ and $V_{LCD2}$.

Note that each of the LCD drive voltages are ultimately in some voltage relationship to $V_{LCD3}$. $V_{LCD3}$ dynamically alters itself to maintain proper bias, therefore all the other LCD drive voltages ($V_{LCD1}$, $V_{LCD2}$, and $V_{LCD4}$) also dynamically vary to maintain their relationship to $V_{LCD3}$. From the analysis of circuit 30, it is evident that $V_{LCD3}$ is advantageously obtained by matching circuit 30 to an LCD's device physics characteristics, thereby dynamically controlling the bias to ensure nominal contrast over both variations in power supply voltage $V_{DD}$, temperature and variations in LCD loading (thereby varying $V_{LCD5}$).

Circuit 30 also allows for manual adjustment of bias of $V_{LCD3}$ via alteration of potentiometer R8. Recall that $K_2$ of circuit 30 was $f_5$(R8, R9, R16, R18, $V_Z$). Adjustment of R8 allows for manual adjustment of $V_{LCD3}$ for two primary purposes. In one case, an LCD material is specced nominally and may vary +/−X%, where "X" is provided by the manufacturer and represents his variations due to the LCD's manufacturing process. Since $K_1$ and $K_2$ were calculated with a nominal $V_{OFF}$ in mind, manual adjustment may be required to adjust for variations away from the nominal $V_{OFF}$ value. A second purpose in allowing manual adjustment of $V_{LCD3}$ via potentiometer R8 is personal preference. One may prefer a heavy contrast or a light contrast. Manual adjustment allows one to take into account their personal contrast preferences.

Circuit 30 also has voltage control circuit 39 that provides $V_{LCD5}$. As is known among LCD driver designers, LCDs need a minimum LCD voltage across the LCD ($V_{LCD}=V_{DD}-V_{LCD5}$). Because the supply voltage $V_{DD}$ is substantially fixed except for battery wear, etc., the voltage $V_{LCD5}$ is used to provide that voltage needed. Voltage control circuit 39 may be implemented through either a voltage doubler circuit or a voltage tripler circuit depending upon the amount of voltage headroom required for that particular LCD application. Other circuits that provide sufficient voltage headroom would also fall within the scope of this invention.

A functional description of circuit 40 is now provided. As you recall, $V_{LCD3}$ could be approximated by:

$$V_{LCD3}\approx K_1V_{LCD}+V_{DD}+K_2.$$

Circuit 40 novelly creates a linear voltage relationship as follows:

$$V_{LCD3}(\text{circuit } 40)=K_1V_{LCD}+K_3V_{DD},$$

where $K_3$ can vary according to the manual contrast adjust which will be discussed infra. Therefore circuit 40 differs from circuit 30 of FIG. 3 by not providing the constant $K_2$. However, circuit 40 is still dynamic and self-adjusts with variations due to temperature, battery wear and LCD capacitive loading. This provides sufficient bias in many circuit applications. Therefore circuit 40, as does circuit 30, dynamically controls LCD bias to provide proper $V_{OFF}$ voltage, thereby overcoming the difficulties of the prior art.

Circuit 40 has a different form of manual contrast adjust than circuit 30 of FIG. 3. Circuit 40 has a digital-type, 32 bit manual contrast control that allows one to adjust the contrast due to LCD variance and user preference. The 32 bit control is effectuated by a 5 bit digital word (CNT0–CNT4) which may be altered by keystrokes. As the 5 bit digital word is altered, differing resistors (R20–R24) are coupled in parallel to provide a varying resistance to the negative input terminal to op-amp 36. In this manner, manual contrast control is provided.

Circuits 30 and 40 could be manually adjusted by either the potentiometer (linear) control circuitry methodology or the multi-bit (digital) control circuitry methodology. Implementation of either method is contemplated for either full dynamic bias control (as illustrated in circuit 30) or partial dynamic bias control (as demonstrated in circuit 40).

Although the invention has been described with reference to the preferred embodiment herein, this description is not to be construed in a limiting sense. Various modifications of the disclosed embodiment as well as other embodiments of the invention, will become apparent to persons skilled in the art upon reference to the description of the invention. It is therefore contemplated that the appended claims will cover any such modifications or embodiments as fall within the true scope of the invention.

What is claimed is:

1. A circuit for generating a series of LCD bias signals, said circuit comprising:

a variable reference voltage source outputting a variable reference voltage ($V_{REF}$);

a first component receiving said variable reference voltage and generating a third LCD bias voltage ($V_{LCD3}$) dependent on said variable reference voltage and between said supply voltage ($V_{DD}$) and a fifth LCD bias voltage ($V_{LCD5}$);

a second component generating a fourth LCD bias voltage ($V_{LCD4}$) having a magnitude equal to $(V_{LCD3}-V_{LCD5})/2+V_{LCD5}$;

a third component generating a second LCD bias voltage ($V_{LCD2}$) having a magnitude equal to $V_{DD}-(V_{LCD3}-V_{LCD5})$; and a fourth component generating a first LCD bias voltage ($V_{LCD1}$) having a magnitude equal to $(V_{LCD2}-V_{DD})/2+V_{DD}$.

2. The circuit of claim 1, said first, second, third, and fourth components further comprising operational amplifiers.

3. The circuit of claim 1, said first component comprising:

an operation amplifier having a positive input, a negative input, and an output, said positive input connected to said variable reference voltage;

a first resistor connected between said supply voltage ($V_{DD}$) and said negative input; and a second resistor connected between said negative input and said output.

4. The circuit of claim 1, said second component comprising;

a resistor pair connected in series between said third LCD bias voltage ($V_{LCD3}$) and said fifth LCD bias voltage ($V_{LCD5}$); and an operational amplifier configured as a voltage follower, a positive input of said operation amplifier connected to a junction between said resistor pair.

5. The circuit of claim 1, said third component comprising:

an operational amplifier having a positive input biased between said supply voltage ($V_{DD}$) and said fifth LCD bias voltage ($V_{LCD5}$);

a first resistor connected between said third LCD bias voltage ($V_{LCD3}$) and a negative input of said operational amplifier; and a second resistor connected between said negative input of said operational amplifier and an output of said operational amplifier.

6. The circuit of claim 1, said fourth component comprising;

a resistor pair connected in series between said second LCD bias voltage ($V_{LCD2}$) and said supply voltage ($V_{DD}$); and an operational amplifier configured as a voltage follower, a positive input of said operation amplifier connected to a junction between said resistor pair.

7. The circuit of claim 1, said variable reference voltage source comprising a zener diode.

8. The circuit of claim 1, said variable reference voltage source comprising:

a first resistor and zener diode connected in series between said supply voltage ($V_{DD}$) and said fifth LCD bias voltage ($V_{LCD5}$); and a potentiometer and a second resistor connected in series across said zener diode.

9. A circuit for generating a series of LCD bias signals, said circuit comprising:

a variable current source outputting a reference current;

a first component receiving said variable reference voltage and generating a third LCD bias voltage ($V_{LCD3}$) dependent on said reference current and between a supply voltage ($V_{DD}$) and a fifth LCD bias voltage ($V_{LCD5}$);

a second component generating a fourth LCD bias voltage ($V_{LCD4}$) having a magnitude equal to $(V_{LCD3}-V_{LCD5})/2+V_{LCD5}$;

a third component generating a second LCD bias voltage ($V_{LCD2}$) having a magnitude equal to $V_{DD}-(V_{LCD3}-V_{LCD5})$; and a fourth component generating a first LCD bias voltage ($V_{LCD1}$) having a magnitude equal to $(V_{LCD2}-V_{DD})/2+V_{DD}$.

10. The circuit of claim 9, said first, second, third, and fourth components further comprising operational amplifiers.

11. The circuit of claim 9, said variable current source comprising a plurality of resistors in parallel.

12. The circuit of claim 9, said first component comprising:

an operation amplifier having a positive input, a negative input, and an output, said negative input connected to said variable current source, said positive input biased between said supply voltage ($V_{DD}$) and said fifth LCD bias voltage ($V_{LCD5}$); and a resistor connected between said negative input and said output.

13. The circuit of claim 9, said second component comprising;

a resistor pair connected in series between said third LCD bias voltage ($V_{LCD3}$) and said fifth LCD bias voltage ($V_{LCD5}$); and an operational amplifier configured as a voltage follower, a positive input of said operation amplifier connected to a junction between said resistor pair.

14. The circuit of claim 9, said third component comprising:

an operational amplifier having a positive input biased between said supply voltage ($V_{DD}$) and said fifth LCD bias voltage ($V_{LCD5}$);

a first resistor connected between said third LCD bias voltage ($V_{LCD3}$) and a negative input of said operational amplifier; and a second resistor connected between said negative input of said operational amplifier and an output of said operational amplifier.

15. The circuit of claim 9, said fourth component comprising;

a resistor pair connected in series between said second LCD bias voltage ($V_{LCD2}$) and said supply voltage ($V_{DD}$); and an operational amplifier configured as a voltage follower, a positive input of said operation amplifier connected to a junction between said resistor pair.

* * * * *